US005188139A

United States Patent [19]

Garelick

[11] Patent Number: 5,188,139

[45] Date of Patent: Feb. 23, 1993

[54] FOLDABLE SUPPORT DEVICE

[75] Inventor: Richard J. Garelick, Minneapolis, Minn.

[73] Assignee: Garelick Mfg. Co., St. Paul Park, Minn.

[21] Appl. No.: 789,175

[22] Filed: Nov. 8, 1991

[51] Int. Cl.[5] ..... A61H 3/00

[52] U.S. Cl. ..... 135/67; 135/74; 403/84; 403/116

[58] Field of Search ..... 135/65, 67, 74; 297/5, 297/6; 482/66, 68; 403/116, 117, 84

[56] References Cited

U.S. PATENT DOCUMENTS

| | | | |
|---|---|---|---|
| 3,693,808 | 9/1972 | Rauch | 135/67 X |
| 4,299,507 | 11/1981 | Collins, II | 403/116 |
| 4,619,282 | 10/1986 | Battison | 135/67 |
| 4,830,035 | 5/1989 | Liu | 135/67 |

*Primary Examiner*—Richard E. Chilcot, Jr.
*Assistant Examiner*—Lan M. Mai
*Attorney, Agent, or Firm*—Jacobson and Johnson

[57] ABSTRACT

A weight-supporting walking aid has two side supports joined at the front to a crossmember by couplings which permit the side supports to be folded inward over the crossmember for storage and latch the side supports in the open position for normal use.

4 Claims, 4 Drawing Sheets

FOLDABLE SUPPORT DEVICE

FIELD OF THE INVENTION

This invention is directed toward a personal weight-supporting device which is used to support the weight of a person but which can then be folded up compactly for storage when not in use. In particular, the invention is directed towards providing a weight-supporting device, such as a hand-held and hand-operated walking aid for ambulatory or peripatetic person, which can be folded compactly and placed out of the way when not being used.

DESCRIPTION OF THE PRIOR ART

A number of walking aids, hereinafter walkers, have been designed and used in the past. Conventionally a walker has left and right side supports comprising vertical front and rear legs joined together by a horizontal hand-support member with a horizontal lateral crossmember holding the side supports together at the front legs. The user usually grasps one horizontal side support member in each hand and moves the walker by picking it up and placing it down as he or she moves forward or sometimes drags or rolls (if provided with wheels) the walker along the floor or ground. Conventionally, each side support comprises a generally vertical front and rear leg with an interconnecting upper horizontal member all formed from a single length of metal, usually steel or aluminum, hollow tubing which is bent to form a general upside down U. The crossmember between the front legs of the side supports is also usually made of some hollow rigid metal tubing. Conventionally a foldable or collapsible walker has hinges or pivot connections or attachments between the crossmember and each of the front legs of the side support which allows the side supports to be folded inwardly and laid over one another and over the crossmember to make the walker into a compact unit for storing it when not in use so that it doesn't take up too much space. Usually means are also provided to releasably lock or latch the side supports in place when they are outward or unfolded for normal use so they don't accidentally fold inward. Means are also provided for manually releasing the locking means. In general the hinge or pivotable connection is somewhat complicated thereby significantly adding to the cost of the walker. In addition, there is danger that the user's fingers could get caught while releasing the locking mechanism and folding up the walker. This is a special danger for users who may be somewhat frail.

SUMMARY OF THE INVENTION

The instant invention provides a relatively simple pivot coupling between two parallel tubular extensions. When used as part of a foldable or collapsible walker, or other type of device which during normal use supports a person's weight, it pivotably joins or couples the front leg of each of the side supports to the crossmember to provide the strength necessary to support the user's weight in normal use and yet permits the device to be folded up compactly for storage when not in use. The coupling is of simple design so is less costly to manufacture and therefore adds less cost to the price of the walker. Further, the design is such that there is no danger that the user could be injured by getting a finger caught when manually releasing the latching or locking mechanism and folding up the walker.

In the past most foldable walkers usually required an additional lower bar or strap between the front legs of the side supports to provide additional strength. The pivot coupling of the instant invention provides sufficient strength and support between the crossmember and the front legs of the side supports to eliminate the need for an additional cross strap or bar. This results in some additional leg room clearance for the user.

DESCRIPTION OF THE PREFERRED EMBODIMENTS

Figure 1:
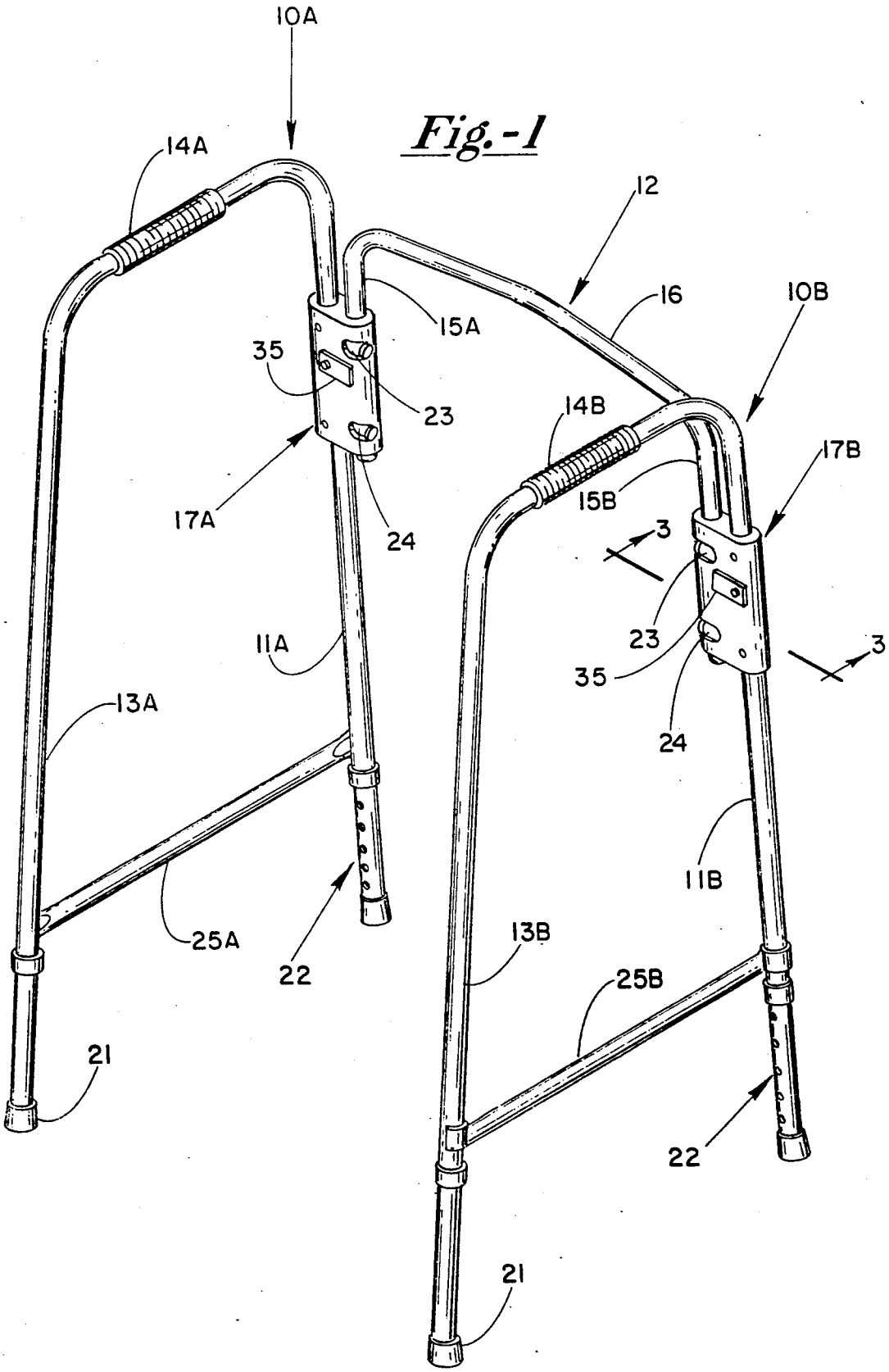
FIG. 1 is a perspective view illustrating a foldable walker made in accordance with the teachings of this invention as it appears in the unfolded condition ready for use.
Figure 2:
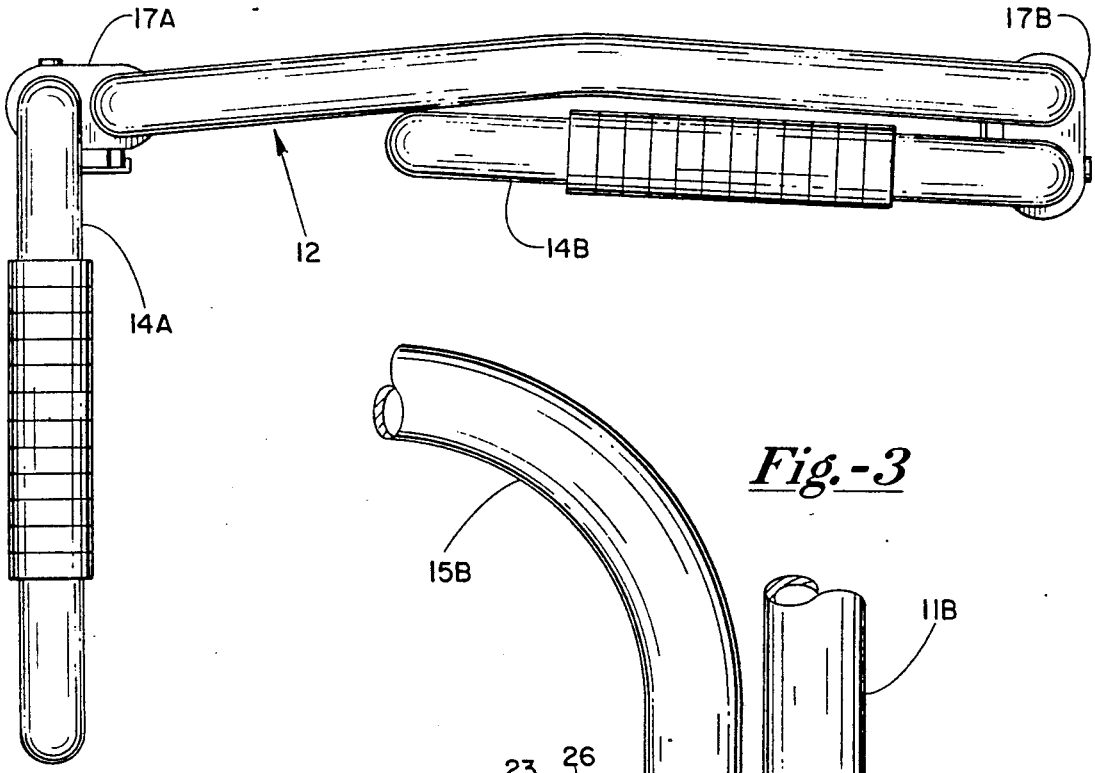
FIG. 2 is a top view of a foldable walker showing one of the sides members in the folded position.
Figure 3:
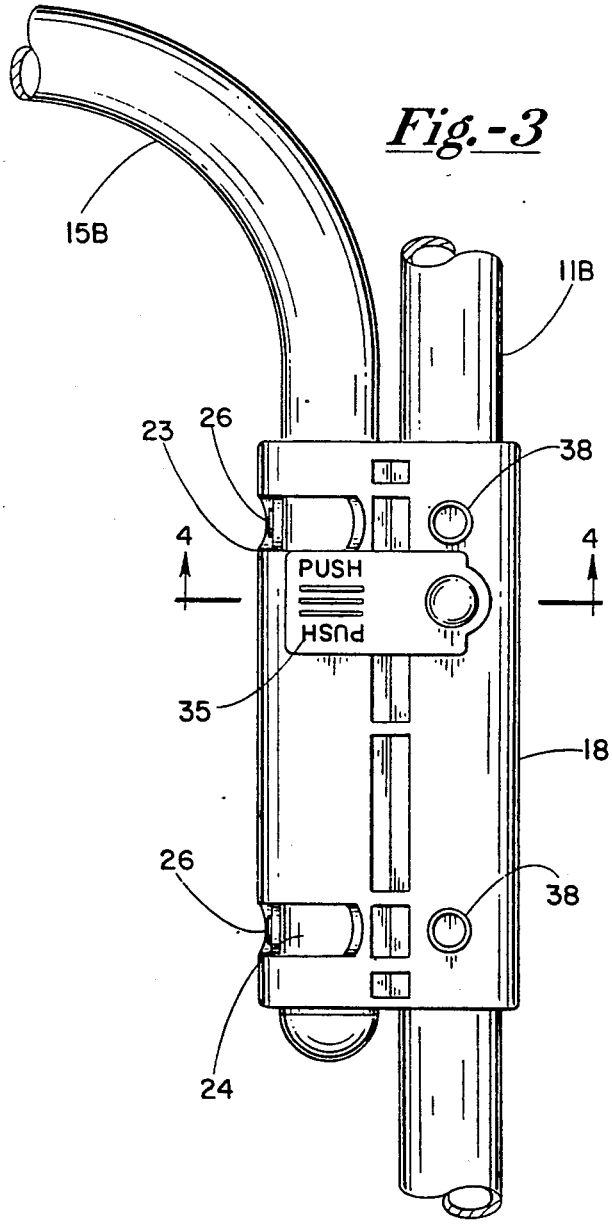
FIG. 3 is an enlarged plan view of the preferred embodiment of the pivot coupling used on a walker.
Figure 4:
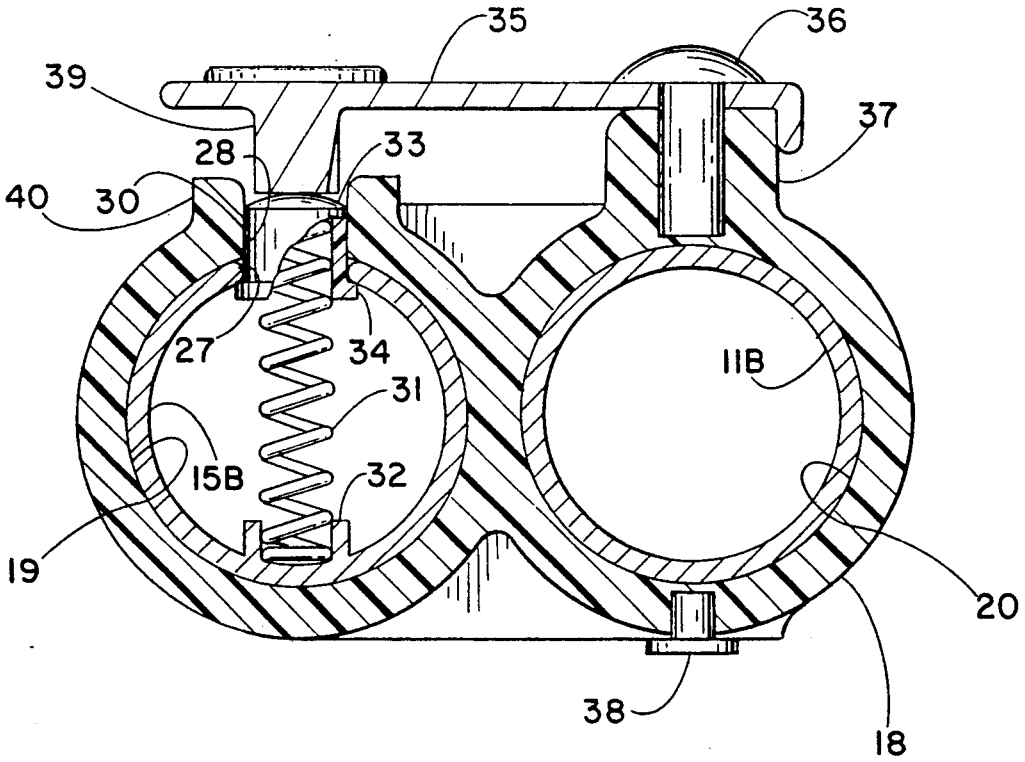
FIG. 4 is a sectioned view of the coupling showing a walker locked in the open or use condition.
Figure 5:
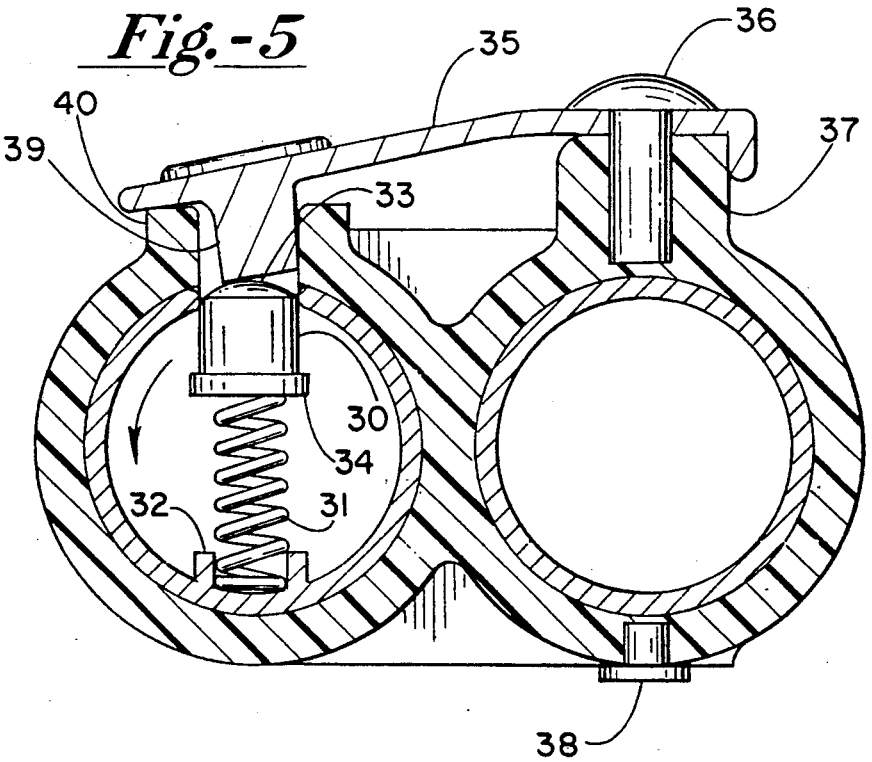
FIG. 5 is a view similar to FIG. 4 showing the lock mechanism being released.
Figure 6:
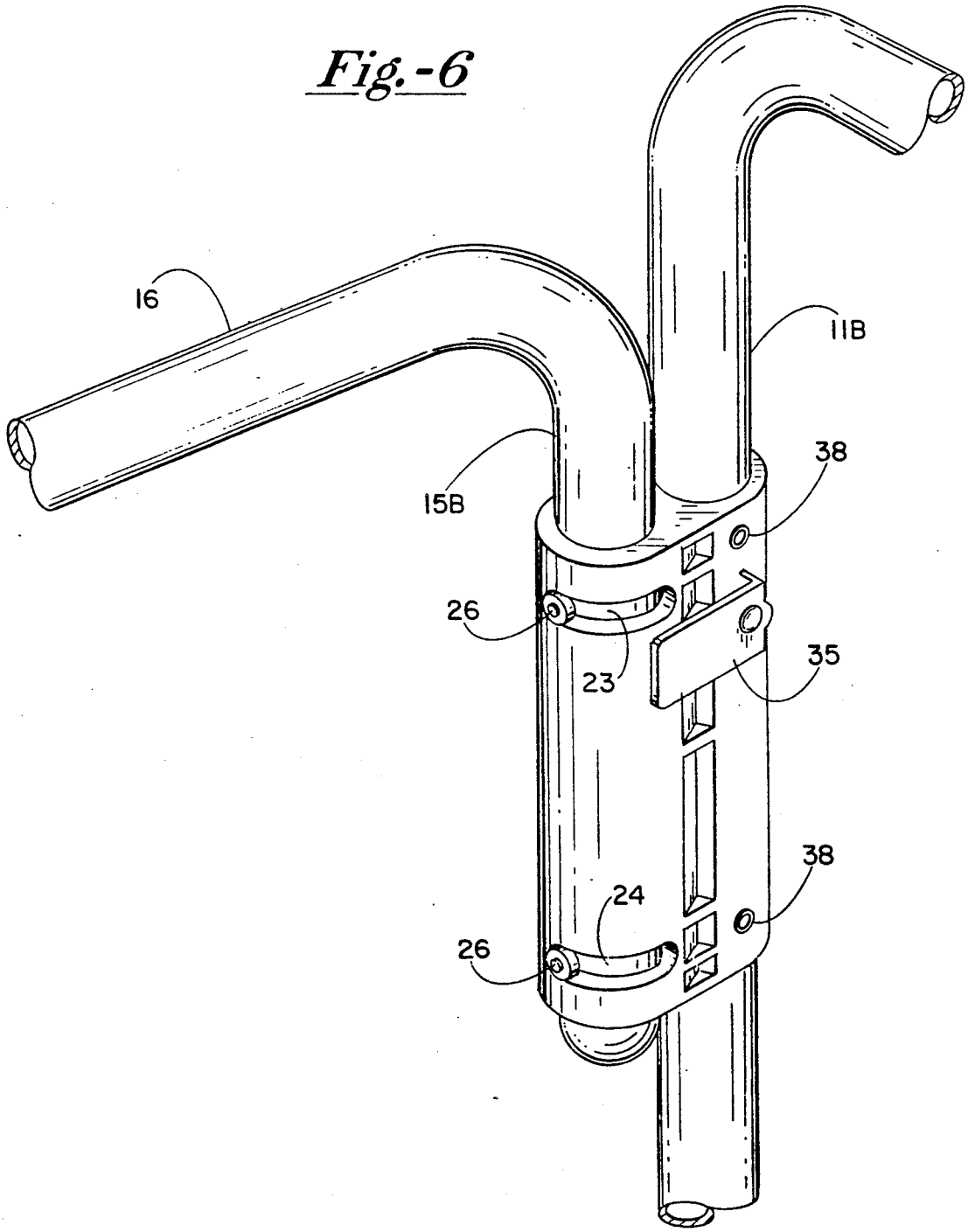
FIG. 6 is a somewhat enlarged perspective view of a preferred form of the pivot coupling.

A walker has conventional left and right identical side supports respectively identified in general by reference numerals 10A and 10B. The left side support 10A conventionally has a vertical disposed front leg 11A, a vertically disposed rear support leg 13A and a horizontal hand support member 14A between the tops of the two legs. Typically and conventionally each of the side supports 10A and 10B are formed out of a single length of hollow metal, steel or aluminum, tubing. Right side support 10B is identical to side support 10A and has a front leg 11B, a rear leg 13B and a horizontal hand support 14B between the front and rear legs. Conventionally, the vertical legs of the side supports terminate at their lower end with wheels or casters (not shown) for rolling the walker or with rubberized anti-slip tips 21. Also, the vertical legs conventionally have means, generally designated by reference numeral 22, for adjusting the length of the legs to accommodate persons of various heights. The side supports 10A and 10B are shaped in the form of a deep upside down U and usually have cross-bars 25A and 25B for added strength.

Extending between the front legs 11A and 11B is a crossmember generally identified by reference numeral 12. Crossmember 12 is made from a single piece of a hollow tube of metal, steel or aluminum, and is formed in a shallow upside down U shape having short or stubby left and right vertical segments or sections respectively identified by reference numbers 15A and 15B which are joined together at their upper end by a horizontal lateral segment or section 16.

Vertical sections 15A and 15B are respectively attached to corresponding front legs 11A and 11B by pivot couplings 17A and 17B. Couplings 17A and 17B are identical to one another and join the respective vertical crossmember sections and vertical side support legs together in the same fashion. Therefore, the construction and function of coupling 17B will only be described with the understanding that the same functional and structural aspects apply correspondingly to coupling 17A.

Coupling 17B comprises a rigid housing 18, preferably molded plastic, having a pair of parallel but separated cylindrical through passageways 19 and 20. Passageway 20 is dimensioned so that leg 11B can be inserted snugly and passageway 19 is dimensioned so that vertical section 15B of crossmember 12 can be inserted snugly but movably. Rivets or pins 38 are inserted radially through housing 18 into passageway 20 to butt up against or to pierce through vertical leg 11B so that it cannot move within passageway 20 and is affixed to coupling 17B. Extending radially outward from passageway 19 through housing 18 are upper and lower slots 23 and 24, respectively, which are identical and parallel to one another. Slots 23 and 24 extend circumferentially slightly greater than about ninety degrees around passageway 19. Extending radially outward from vertical section 15B are a pair of studs 26 which are engaged in slots 23 and 24. Studs 26 are dimensioned so that they fit snugly but movably in slots 23 and 24 to allow coupling 17B to be rotated about vertical section 15B between the two limits or ends of slots 23 and 24, amounting to about ninety degrees, while at the same time preventing any significant longitudinal or lengthwise movement between coupling 17B and vertical crossmember section 15B.

As a safety precaution, to prevent side supports 10A and 10B from being accidentally swung or folded inward when in normal use, a releasable locking or latching mechanism is provided. The locking or latching mechanism per se is conventional. Vertical segment 15B has a generally circular aperture 27 through the wall of the tubing and housing 18 has a similarly shaped and dimensioned aperture 28 passing radially outward through a raised boss 40 formed on the outside of housing 18 opposite passageway 19. A short stubby cylindrical pin 30 dimensioned to slide snugly in apertures 27 and 28 extends radially outward from the interior of vertical segment 15B and is urged in that direction by a compressible spring 31 located in the interior of vertical segment 15B and attached thereto in some convenient or conventional fashion at 32. The outer end 33 of pin 30 is curved or dome-shaped to enable it to slide easily into apertures 27 and 28 and the interior end of pin 30 has a cap 34 which is dimensioned to be larger than aperture 27 so that pin 30 cannot be ejected from vertical section 15B. The locking mechanism operates in a conventional fashion that when apertures 27 and 28 are aligned with one another, spring 31 forces pin 30 into apertures 27 and 28 which then locks segment 15B with respect to housing 18. To release the locking or latching mechanism a tab 35 is attached by a rivet 36 or some other securing device to the outside of a raised boss 37 on housing 18 opposite passageway 20 and extends over the outside of housing 18 to passageway 19 and has an axial inwardly directed extension 39 at its distal end dimensioned generally to fit into aperture 28. Tab 35 may be a strap of some suitable metal and acts as a cantilevered spring arm so when depressed or pushed radially inward at its free end it pushes pin 30 against the force of spring 31 into the interior of vertical segment 15B disengaging pin 30 from aperture 28 so that coupling 17B along with side support 10B can be rotated about segment 15B to fold up the walker. An important aspect of the lock releasing mechanism relative to folding the side support inward is the absence of any significant openings or gaps which could catch and injure the user's fingers when he or she releases the latching mechanism and folds up the walker in the manner described. Conventionally, to fold up the walker a finger of one hand is used to depress the end of tab 35 while the other hand is used to swing the side support inward. The pivot housing containing the two parallel interior passageways to enable the side support to be swung or rotated about the crossmember vertical segment has no obstacles or openings or recesses which might pinch or otherwise damage the user's fingers.

In most earlier foldable walkers the crossmember extended from one side support front let to the other so when the walker was folded it had a width equal to about the length of the crossmember. A walker constructed according to the teachings of the instant invention has a crossmember which is somewhat shorter than earlier devices, by an amount equal to about the width of one of the couplings. As a result the folded walker is that much less wide than earlier folded walkers.

It should be understood that devices other than walkers, e.g., a foldable portable toilet, can be constructed according to the teachings of this invention.

I claim:

1. A portable foldable weight-supporting device, comprising:

a pair of spaced-apart side supports, each of said side supports comprising rigid, tubular, vertical, weight-supporting front and back legs joined together at their upper ends by a horizontal rigid member;

a rigid tubular elongated cross-member between the front legs of said side supports, said cross-member having a generally horizontal section terminating with a vertical section at each end, each vertical section parallel to and adjacent a side support front leg;

a pair of couplings, each of said couplings pivotably joining one of said side support front legs to the adjacent cross-member vertical section;

each of said couplings comprising a housing having a pair of parallel spaced-apart tubular passageways, a side support front leg fixedly engaged in one of said passageways and the adjacent cross-member vertical section movably engaged in the other of said passageways; and means for preventing said cross-member vertical section from moving lengthwise in said other passageway while permitting said cross-member vertical section to be rotated in said other passageway whereby said side support can be pivotably swung about said cross-member vertical section.

2. The portable foldable weight supporting device as described in claim 1 wherein said preventing means comprises:

a stud jutting radially outward on each cross-member vertical section; and a peripheral slot at least partway around said other passageway, said stub engaging said slot.

3. The portable foldable weight supporting device as described in claim 2 wherein said slot extends about ninety degrees around said other passageway, the ends of said slot making contact with said stub to prevent said side support from swinging more than about ninety degrees about said cross-member vertical section.

4. The portable foldable weight supporting device as described in claim 2 further including:

means engaged in part with each of said couplings for releasably locking the coupling when the side support is pivotably swung about ninety degrees with respect to the cross-member vertical section.

* * * * *